US008985032B1

(12) United States Patent
Johnson

(10) Patent No.: US 8,985,032 B1
(45) Date of Patent: Mar. 24, 2015

(54) ADJUSTABLE DESK APPARATUS

(71) Applicant: Jamie M. Johnson, Davison, MI (US)

(72) Inventor: Jamie M. Johnson, Davison, MI (US)

( * ) Notice: Subject to any disclaimer, the term of this patent is extended or adjusted under 35 U.S.C. 154(b) by 0 days.

(21) Appl. No.: 14/049,323

(22) Filed: Oct. 9, 2013

(51) Int. Cl.
*A47B 51/00* (2006.01)
*A47B 21/02* (2006.01)

(52) U.S. Cl.
CPC ..... *A47B 21/02* (2013.01)
USPC ..... 108/97; 108/106; 108/90; 108/93

(58) Field of Classification Search
USPC ..... 108/106, 107, 110, 42, 50.11, 90, 93, 108/95, 96, 97, 144.11, 147
See application file for complete search history.

(56) References Cited

U.S. PATENT DOCUMENTS 3,140,559 A * 7/1964 Grow et al. ..... 108/6
3,698,327 A * 10/1972 Litvinoff et al. ..... 108/2
4,590,865 A 5/1986 Rutsche et al.
4,703,700 A 11/1987 Sema
5,161,868 A * 11/1992 Hooser ..... 312/223.4
5,282,427 A * 2/1994 Steinhilber ..... 108/97
5,823,120 A 10/1998 Holmquist
5,829,501 A * 11/1998 DeVito ..... 144/286.1
6,076,785 A 6/2000 Oddsen, Jr.
6,119,605 A * 9/2000 Agee ..... 108/147
6,550,724 B2 4/2003 Gosling
7,412,931 B2 * 8/2008 Seidl et al. ..... 108/147
2004/0035336 A1 2/2004 Coble
2005/0248239 A1 * 11/2005 Newhouse et al. ..... 312/194
2007/0131149 A1 * 6/2007 Mayben ..... 108/97
2007/0215765 A1 * 9/2007 Nagel et al. ..... 248/161

* cited by examiner

*Primary Examiner* — Daniel Rohrhoff
(74) *Attorney, Agent, or Firm* — Dale J. Ream

(57) ABSTRACT

An adjustable desk apparatus includes an auxiliary work surface that is movable between a sitting configuration and a standing configuration. When in the sitting configuration, the auxiliary work surface is located adjacent to a primary work surface of an existing desk so as to accommodate working while sitting. When in the standing configuration, the auxiliary work surface is upwardly displaced from the primary work surface of the existing desk so as to accommodate working while standing. The adjustable desk apparatus also includes a base member that interfaces with the existing desk. An adjustment assembly includes at least one counterweight and corresponding counterweight sprockets configured to selectively urge the auxiliary work surface toward the standing configuration when actuated by a user. A pin couples the auxiliary work surface to the base member so as to hold the auxiliary work surface at a desired location.

18 Claims, 8 Drawing Sheets

ADJUSTABLE DESK APPARATUS

BACKGROUND OF THE INVENTION

This invention relates generally to office furniture and, more particularly, to an adjustable desk apparatus with an auxiliary work surface that is movable between a sitting configuration adjacent to a primary work surface and a standing configuration displaced from the primary work surface.

Long hours sitting at a desk can be detrimental to a person's health and to their work efficiency. Additionally, someone with health issues, such as back problems, may not be able to sit at a desk all day. And for some, it is just uncomfortable or even boring to sit all day in an office environment. Consequently, it is desirable to have the ability to stand or sit while working at a desk. A sit/stand desk can fulfill this need. For various reasons, however, it may not be feasible to replace a standard sitting desk with a sit/stand desk. An adjustable desk apparatus can add-on to a standard sitting desk to provide a worker with an auxiliary work surface that is quickly and easily movable between a sitting configuration and a standing configuration.

Various devices have been proposed in the art for providing work surfaces that are movable between a sitting configuration and a standing configuration. Although assumably effective for their intended purposes, the current devices do not add-on to an existing desk and/or they do not provide an auxiliary work surface that is movable between a sitting configuration and a standing configuration.

Therefore, it would be desirable to have an adjustable desk apparatus that adds-on to a standard sitting desk with an auxiliary work surface that is quickly and easily movable between a sitting configuration and a standing configuration. Further, it would be desirable to have an adjustable desk apparatus that utilizes a counterweight to assist in quickly and easily moving the auxiliary work surface from the sitting configuration to the standing configuration and vice versa.

SUMMARY OF THE INVENTION

An adjustable desk apparatus according to the present invention includes an auxiliary work surface that is movable between a sitting configuration and a standing configuration. When in the sitting configuration, the auxiliary work surface is located adjacent to a primary work surface of an existing desk. When in the standing configuration, the auxiliary work surface is upwardly displaced from the primary work surface of the existing desk.

The adjustable desk apparatus also includes a base member and an adjustment assembly. The auxiliary work surface is selectively coupled to the base member when the auxiliary work surface is in the standing configuration. The adjustment assembly is operatively coupled to the auxiliary work surface and the base member so as to assist in moving the auxiliary work surface between the sitting configuration and the standing configuration. The base member is selectively coupled to the primary work surface.

Therefore, a general object of this invention is to provide an adjustable desk apparatus that adds-on to an existing standard sitting desk.

Another object of this invention is to provide an adjustable desk apparatus, as aforesaid, with an auxiliary work surface that is movable between a sitting configuration and a standing configuration.

Still another object of this invention is to provide an adjustable desk apparatus, as aforesaid, that utilizes an adjustment assembly to assist in moving the auxiliary work surface between the sitting configuration and the standing configuration.

Yet another object of this invention is to provide an adjustable desk apparatus, as aforesaid, with a base member that selectively couples to an existing standard sitting desk.

A further object of this invention is to provide an adjustable desk apparatus, as aforesaid, that is easy to setup and easy to use.

A still further object of this invention is to provide an adjustable desk apparatus, as aforesaid, that is inexpensive to manufacture.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1A:
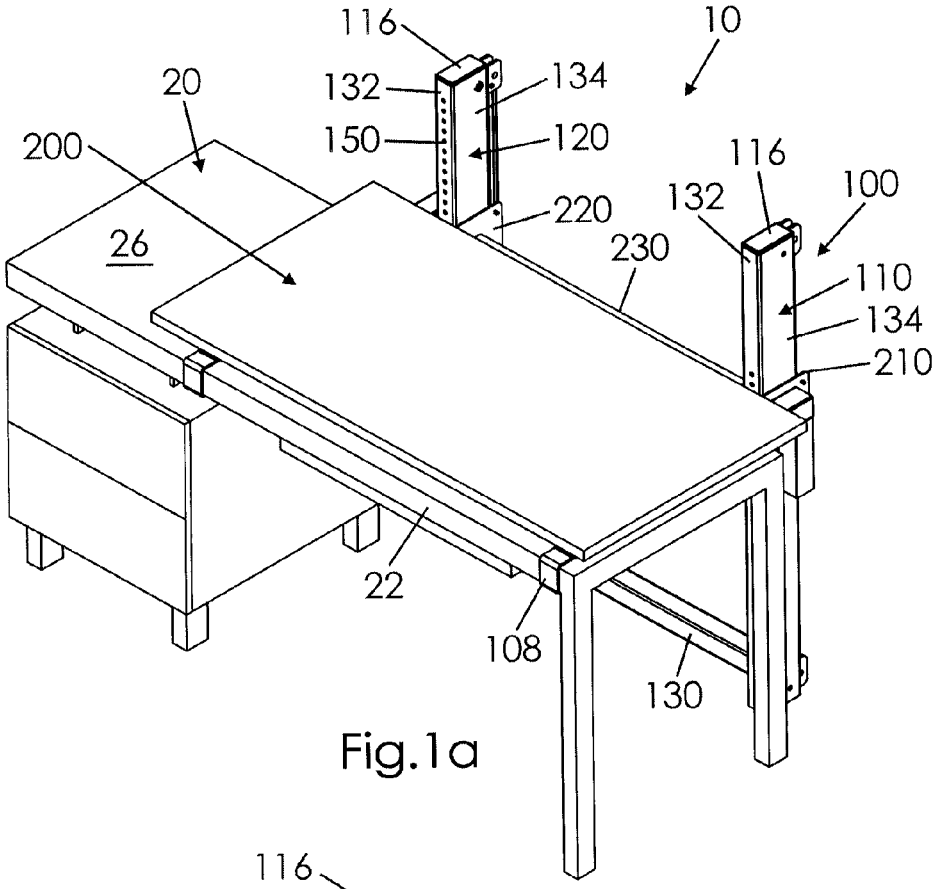
FIG. 1*a* is a perspective view of the adjustable desk apparatus selectively coupled to a desk.
Figure 1B:
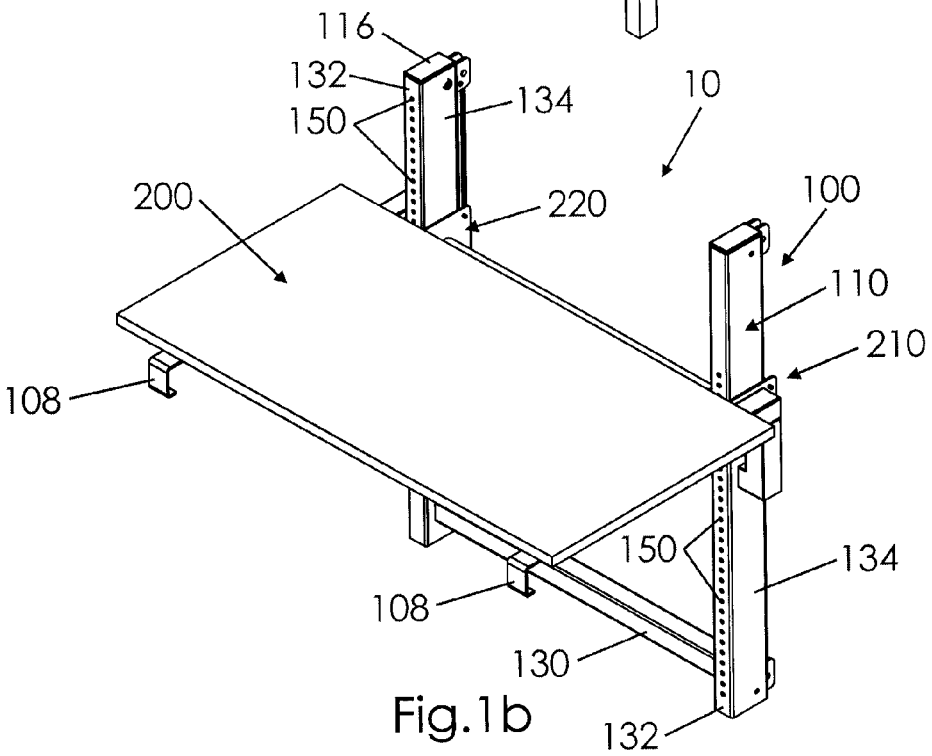
FIG. 1*b* is a perspective view of the adjustable desk apparatus, as in FIG. 1, decoupled from the desk.

An adjustable desk apparatus according to a preferred embodiment of the present invention will now be described with reference to FIGS. 1*a* to 8*b* of the accompanying drawings. The adjustable desk apparatus 10 is configured to selectively sit on top of a primary work surface 20, such as on a traditional sitting desk or other work surface. The adjustable desk apparatus 10 includes a base member 100, an auxiliary work surface 200, and a first adjustment assembly 300. The first adjustment assembly 300 is operatively coupled to the base member 100 and the auxiliary work surface 200 so as to move the auxiliary work surface 200 between a sitting configuration adjacent to the primary work surface 20 and a standing configuration upwardly displaced from the primary work surface 20.

The base member 100 may include first 102 and/or second 104 stability members. The base member 100 may also include at least one foot pad. The foot pad 106 may be made of a relatively soft material so as to protect the primary work surface 20 from being damaged by the base member 100 of the adjustable desk apparatus 10 when the adjustable desk apparatus 10 is selectively coupled to the primary work surface 20.

Figure 2A:
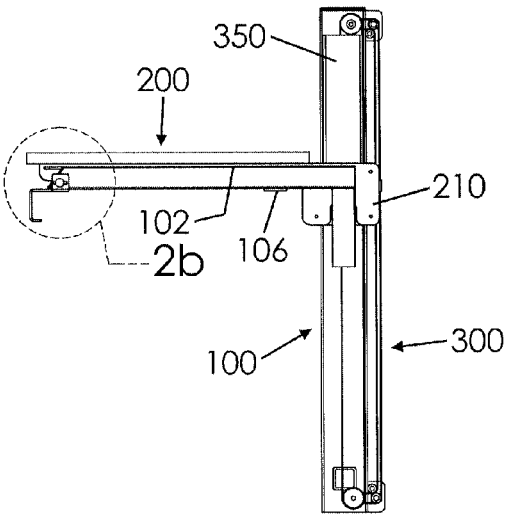
FIG. 2*a* is a side elevation view of the adjustable desk apparatus, as in FIG. 1*b*, with an auxiliary work surface shown in a sitting configuration and a first stanchion removed to show the position of a counterweight.
Figure 2C:
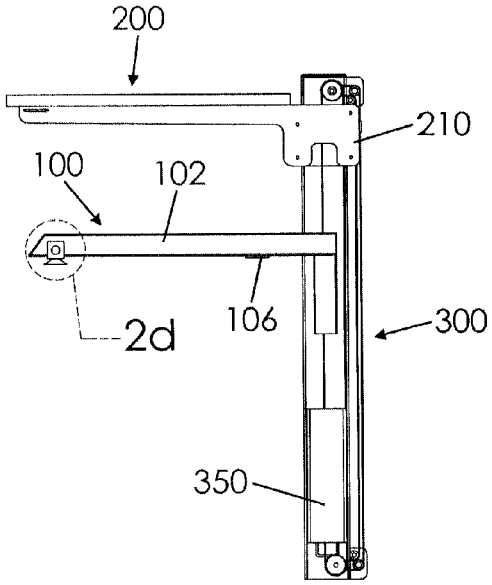
FIG. 2*c* is a side elevation view of the adjustable desk apparatus with a first stanchion removed to show the position of a counterweight, as in FIG. 2*a*, with the auxiliary work surface in a standing configuration and showing a surface mounting fastener rather than an edge mounting fastener.
Figure 2B:
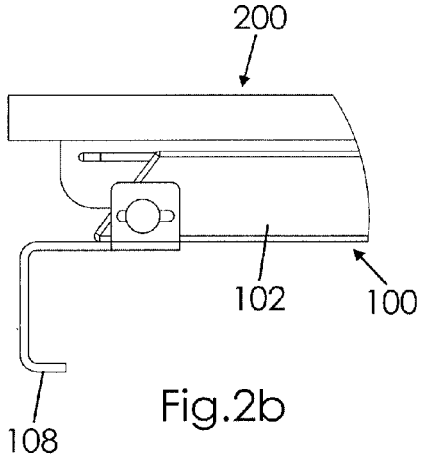
FIG. 2*b* is an isolated view on an enlarged scale, taken from FIG. 2*a*, showing an edge mounting fastener.
Figure 2D:
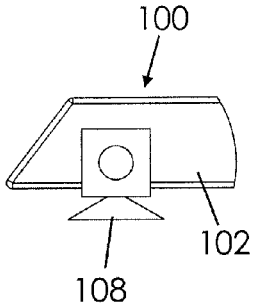
FIG. 2*d* is an isolated view on an enlarged scale, taken from FIG. 2*b*, showing a surface mounting fastener.

In one embodiment, the first 102 and/or second 104 stability member may include a fastening member 108, such as a hook, that is selectively coupled to a first edge 22 of the primary work surface 20. The fastening member 108 may be adjustable so as to accommodate different sizes of primary work surfaces 20. In another embodiment, the fastening members 108 may selectively couple to a fastening surface 26 of the primary work surface 20. More particularly, each fastening member 108 may be a suction cup or any other fastener known in the art to have surface mounting capabilities (FIGS. 2*c* and 2*d*).

The base member 100 may further include a generally vertical first stanchion 110. Alternatively, all or part of the first stanchion 110 may extend from the primary work surface 20 at a measurable angle above and/or below horizontal. The first stanchion 110 may include opposed front 112 and rear 114 walls with opposed side walls 115 extending between respective ends of the front 112 and rear 114 walls, respectively. A top cap 116 may extend between respective side walls 115 and respective front 112 and rear 114 walls such that the walls and the top cap 116 together define an interior area 118. Accordingly, the first stanchion 110 may present a generally square or rectangular configuration although other configurations may also be suitable.

The first stanchion 110 may define at least one hole 150 configured to selectively receive a first pin 251. The first pin 251 may be coupled to the auxiliary work surface 200 so as to hold the auxiliary work surface 200 at the standing configuration when the hole 150 of the first stanchion 110 receives the first pin 251. Further, the first stanchion 110 may define a plurality of spaced apart holes 150 configured to selectively receive the first pin 251 such that the auxiliary work surface 200 is held at a selected vertical position relative to the primary work surface 20 when the first pin 251 is coupled to the auxiliary work surface 200 and one of the plurality of holes 150 receives the first pin 251.

Figure 4A:
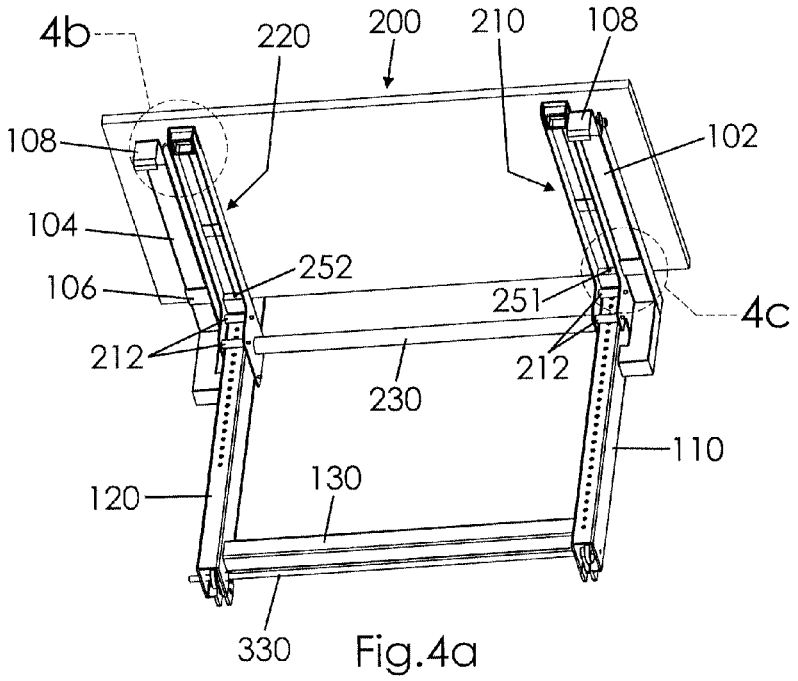
FIG. 4*a* is a perspective view of the adjustable desk apparatus, as in FIG. 1*b*, shown from a different angle than FIG. 1*b;*
Figure 4B:
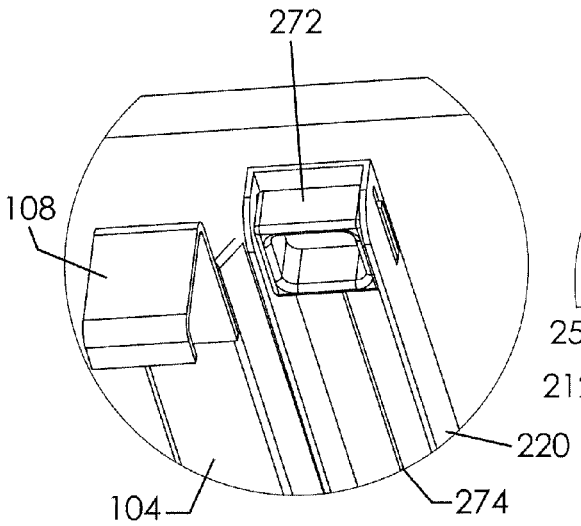
FIG. 4*b* is an isolated view on an enlarged scale taken from FIG. 4*a;*
Figure 4C:
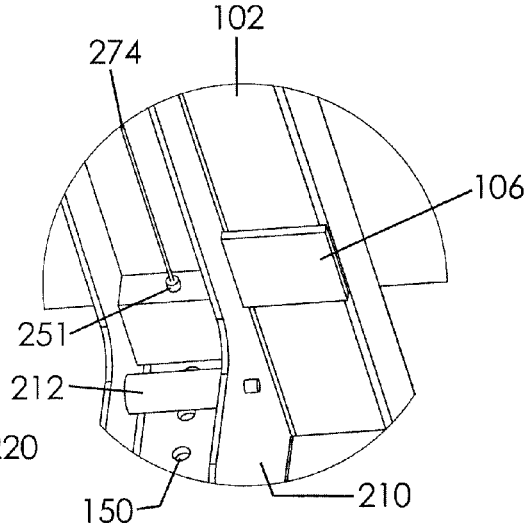
FIG. 4*c* is an isolated view on an enlarged scale taken from FIG. 4*a.*
Figure 5A:
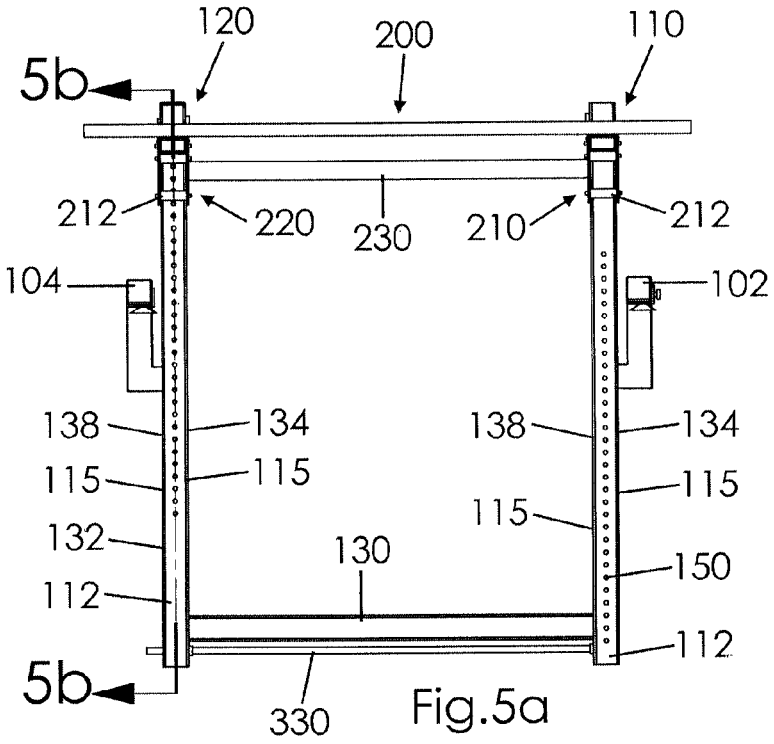
FIG. 5*a* is a front view of the desk apparatus as in FIG. 2.
Figure 5B:
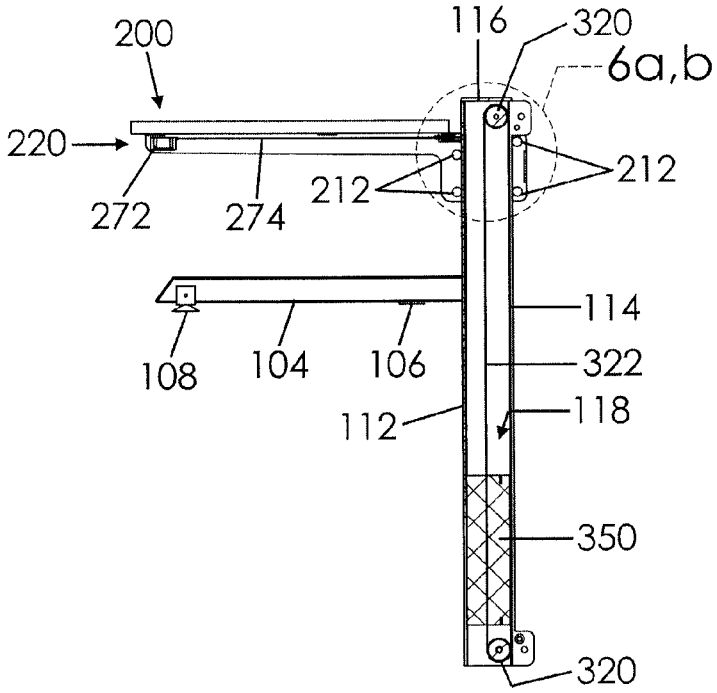
FIG. 5*b* is a sectional view taken along line 5*b*-5*b* of FIG. 5*a;*

The first pin 251 may be coupled to the auxiliary work surface 200. A spring 250 may bias the first pin 251 towards the first stanchion 110. The auxiliary work surface 200 may include a position lock release handle 272 operatively coupled to the first pin 251 (FIGS. 4*a* to 4*c*). The position lock release handle 272 of the auxiliary work surface may be selectively movable between a relaxed configuration that allows the first pin 251 to mate with the hole 150 of the first stanchion 110 and a tensioned configuration that urges the first pin 251 away from the hole 150 of the first stanchion 110. A position lock release cable 274 may be coupled to the position lock release handle 272 such that the position lock release cable 274 pulls the first pin 251 away from the first stanchion 110 when the position lock release handle 272 is moved to the tensioned configuration. The position lock release handle 272 and associated release cable 274 enable a user to selectively release or prevent movement of the auxiliary work surface 200.

The auxiliary work surface 200 may include a first carriage 210 configured to move up and down the first stanchion 110 (FIG. 2*c*). The first pin 251 may be selectively coupled to the first carriage 210. The first carriage 210 may include a set of guides 212 configured to engage opposed first 132, second 134, third 136, and/or fourth 138 surfaces of the first stanchion 110 so as to guide the first carriage 210 as it moves up and down the first stanchion 110 and/or to maintain the auxiliary work surface 200 in a relatively horizontal configuration. The set of guides 212 may consist of any combination of one or more rollers, slides, planer surfaces, or other similar structure capable of guiding and/or supporting the first carriage 210 relative to the first stanchion 110.

The first surface 132 of the first stanchion 110 may be defined by the front wall 112, the rear wall 114, one of the side walls 115, or any other suitable portion of the first stanchion 110. Similarly, the second 134, third 136, and/or fourth 138 surfaces may be defined by any suitable portion of the first stanchion 110. In one embodiment, the set of guides 212 may only engage three surfaces. In another embodiment, the set of guides 212 may engage more than four surfaces.

Figure 7A:
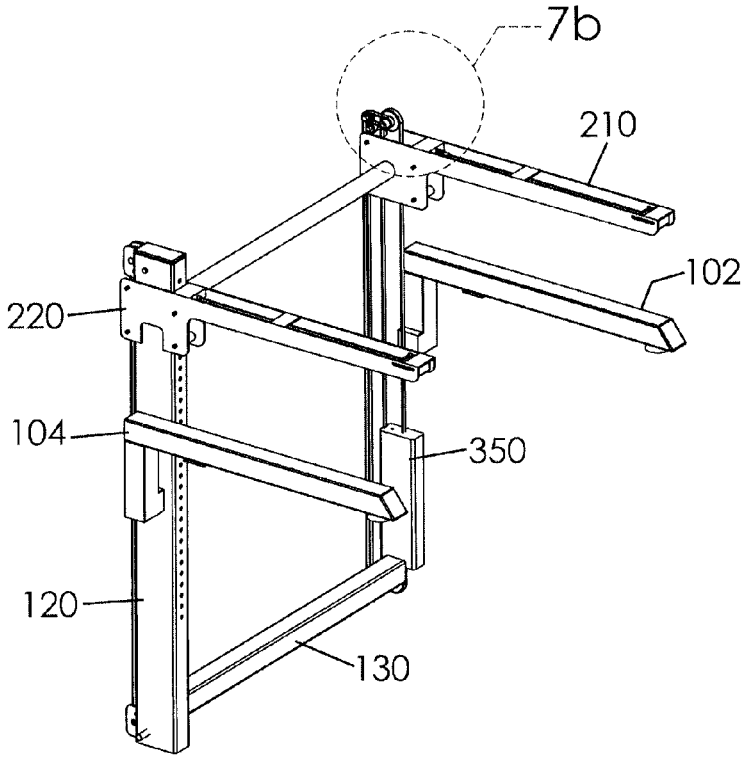
FIG. 7*a* is a perspective view of the adjustable desk apparatus with a first stanchion removed, as in FIG. 2*c*, shown from a different angle than FIG. 2*c;*
Figure 7B:
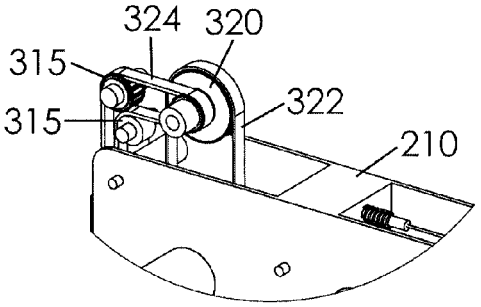
FIG. 7*b* is an isolated view on an enlarged scale taken from FIG. 7*a;*
Figure 7C:
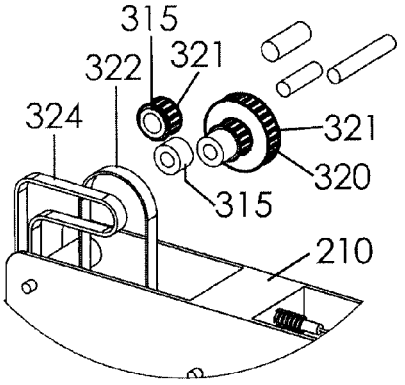
FIG. 7*c* is an exploded view of FIG. 7*b;*
Figure 8A:
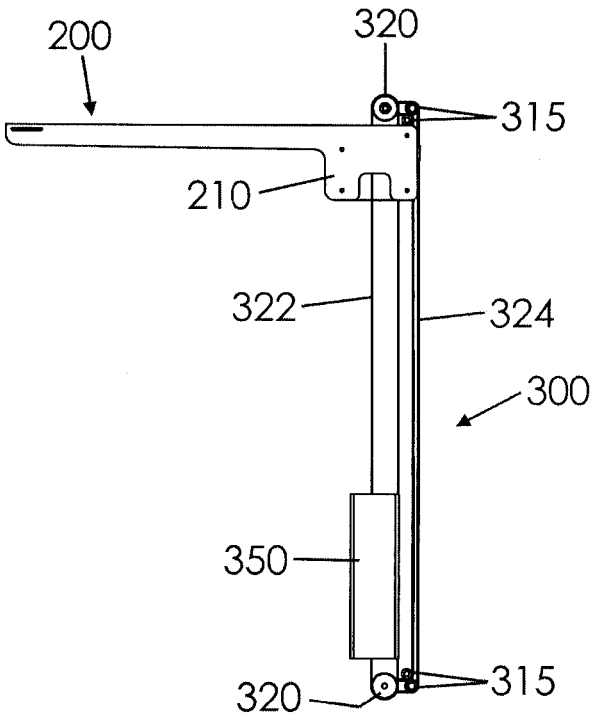
FIG. 8*a* is a side elevation view of one embodiment of a first adjustment assembly and a first carriage.
Figure 8B:
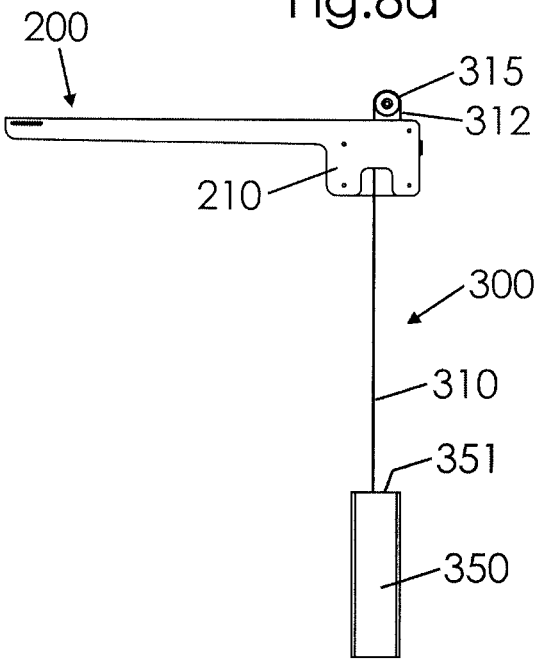
FIG. 8*b* is a side elevation view of another embodiment of the first adjustment assembly and a first carriage.

The first carriage 210 of the auxiliary work surface 200 may be coupled to the first adjustment assembly 300 with a clamp 360. The first adjustment assembly 300 may be located, at least partially, within the interior area 118 of the first stanchion 110. The first adjustment assembly 300 may include at least one idler pulley 315 and at least one counterweight 350 (FIGS. 7*a* to 7*c*).

In one embodiment, the idler pulley 315 is coupled to the first stanchion 110. A first end 311 of a counterweight cord 310 is coupled to a first end 351 of the counterweight 350 and a second end 312 of the counterweight cord 310 is operatively coupled to the auxiliary work surface 200 so as to urge the auxiliary work surface 200 upward toward the standing configuration when the counterweight cord 310 is coupled to the idler pulley 315.

Figure 6A:
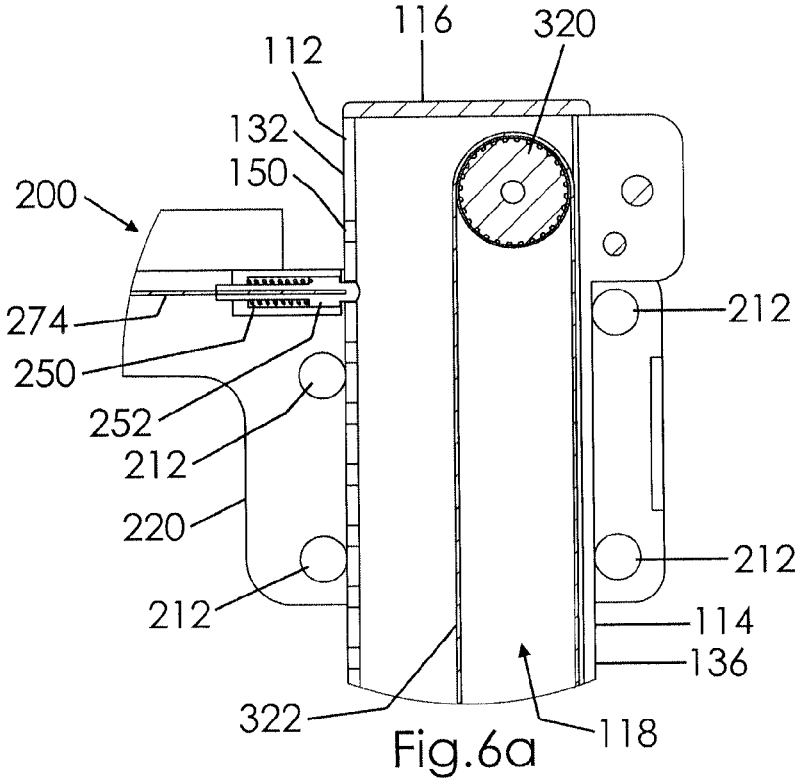
FIG. 6*a* is an isolated view on an enlarged scale taken from FIG. 5*b* with a second pin received by a hole defined by a second stanchion.
Figure 6B:
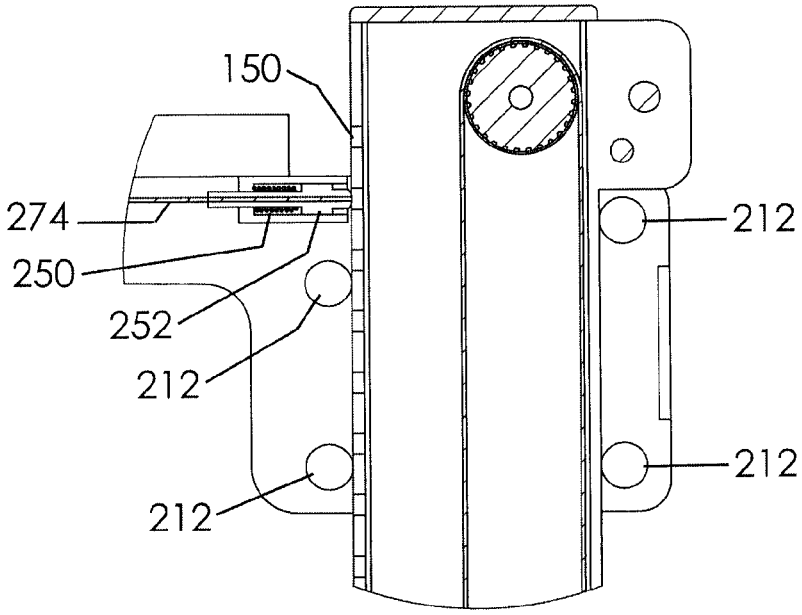
FIG. 6*b* is an isolated view on an enlarged scale taken from FIG. 5*b* with a second pin pulled away from a second stanchion.

In another embodiment, the first adjustment assembly 300 includes a pair of opposed counterweight sprockets 320 and a first timing member 322. The pair of opposed counterweight sprockets 320 includes timing elements 321 such as teeth, cogs, or any similar timing element known in the art (FIG. 6*a*). The first timing member 322 may be a belt, a chain, or any similar timing member that is capable of receiving the timing elements 321 of the counterweight sprockets 320. At least one of the pair of counterweight sprockets 320 is coupled to the first stanchion 110. The first timing member 322 is coupled to the counterweight 350 and operatively coupled to the auxiliary work surface 200 so as to urge the auxiliary work surface 200 upward toward the standing configuration when the first timing member 322 is coupled to the pair of counterweight sprockets 320. The first adjustment assembly 300 may further include at least one idler pulley 315. The idler pulley 315 may include timing elements 321.

In yet another embodiment, the first adjustment assembly 300 includes a pair of opposed counterweight sprockets 320, a first timing member 322, and a second timing member 324. The first 322 and/or the second 324 timing member may be a belt, a chain, or any similar timing member that is capable of receiving the timing elements 321 of the counterweight sprockets 320. At least one of the pair of counterweight sprockets 320 is operatively coupled to the first stanchion 110. The first adjustment assembly 300 may further include at least one idler pulley 315. The idler pulley 315 may include timing elements 321.

In an embodiment having first 322 and second 324 timing members, the first timing member 322 is coupled to the counterweight 350 and to the pair of counterweight sprockets 320. The second timing member 324 is operatively coupled to the auxiliary work surface 200 so as to urge the auxiliary work surface 200 upward toward the standing configuration when the second timing member 324 is coupled to the pair of counterweight sprockets 320. Each of the pair of counterweight sprockets 320 may define a first diameter for the first timing member 322 and a second diameter for the second timing member 324 such that the mass of the counterweight 350 need not match the mass of the auxiliary work surface 200 (including the mass of anything supported by the auxiliary work surface 200) for the first adjustment assembly 300 to neutralize the gravitational force exerted on the auxiliary work surface 200.

Figure 3A:
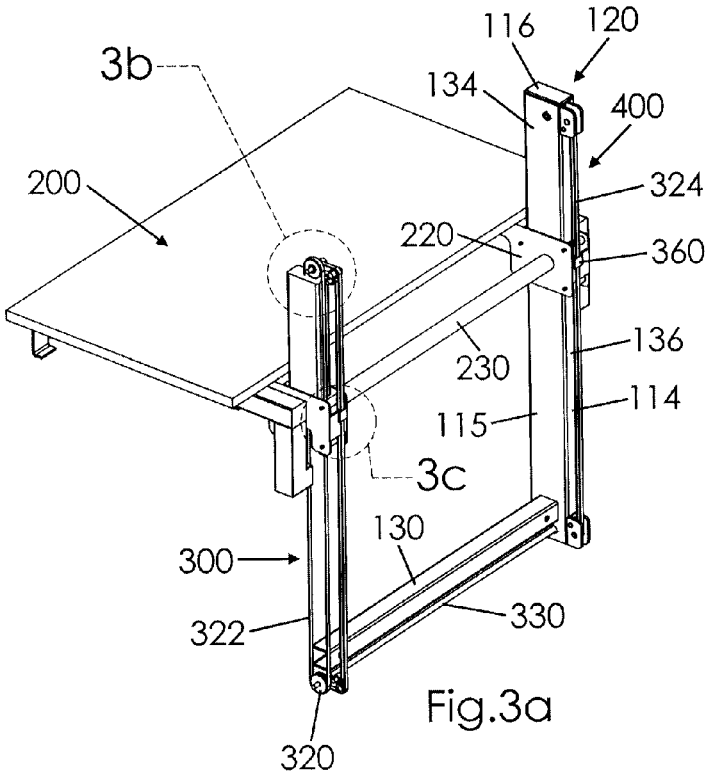
FIG. 3*a* is a perspective view of the adjustable desk apparatus with a first stanchion removed to show the position of a counterweight, as in FIG. 2*a*, shown from a different angle than FIG. 2*a;*
Figure 3B:
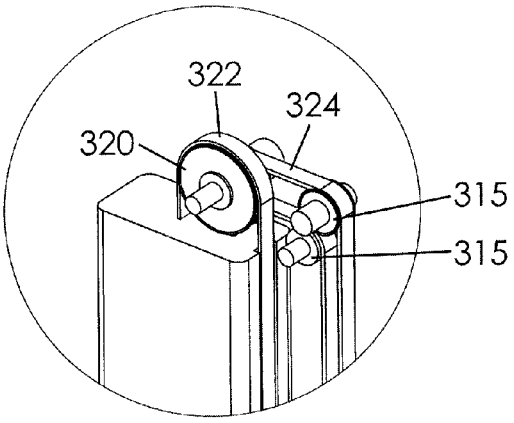
FIG. 3*b* is an isolated view on an enlarged scale taken from FIG. 3*a;*
Figure 3C:
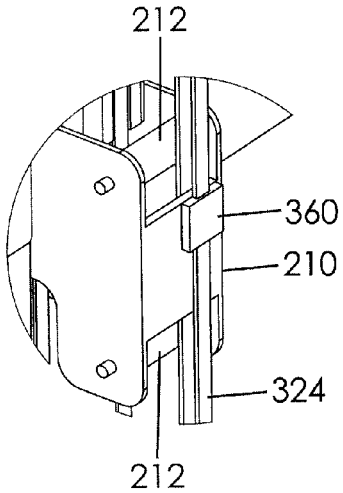
FIG. 3*c* is an isolated view on an enlarged scale taken from FIG. 3*a;*

In one embodiment the adjustable desk apparatus includes a second stanchion 120, a second carriage 220, a second pin 252, and/or a second adjustment assembly 400 (FIG. 3*a*). The second stanchion 120, second carriage 220, second pin 252, and/or second adjustment assembly 400 may include a construction that is substantially similar to that of the respective first stanchion 110, first carriage 210, first pin 251, and/or first adjustment assembly 300.

The base member 100 may include at least one longitudinal member 130 coupled to and extending between respective first 110 and second 120 stanchions. The auxiliary work surface 200 may include at least one longitudinal member 230 coupled to and extending between respective first 210 and second 220 carriages. A timing bar 330 may be coupled to and extend between at least one of the pair of counterweight sprockets 320 of respective first 300 and second 400 adjustment assemblies so as to maintain consistent timing between respective first 300 and second 400 adjustment assemblies during operation thereof.

Opposed first 110 and second 120 stanchions may be used in concert with one or more sets of guides 212 so as to guide respective first 210 and second 220 carriages as they move up and down respective first 110 and second 120 stanchions and/or to maintain the auxiliary work surface 200 in a relatively horizontal configuration. Each set of guides 212 may consist of any combination of one or more rollers, slides, planer surfaces, or other similar feature capable of guiding and/or supporting the first 210 and/or second 220 carriages relative to the first 110 and/or second 120 stanchions.

In another embodiment the adjustable desk apparatus may include multiple stanchions, carriages, pins, and/or adjustment assemblies. Each respective stanchion, carriage, pin, and/or adjustment assembly may include a construction that is substantially similar to that of the respective first stanchion 110, first carriage 210, first pin 251, and/or first adjustment assembly 300.

The base member 100 may include at least one longitudinal member 130 coupled to and extending between at least two respective stanchions. The auxiliary work surface 200 may include at least one longitudinal member 230 coupled to and extending between at least two carriages. A timing bar 330 may be coupled to and extend between at least one of the pair of counterweight sprockets 320 of at least two adjustment assemblies so as to maintain consistent timing between respective adjustment assemblies.

Opposed stanchions may be used in concert with or without one or more sets of guides 212 so as to guide respective carriages as they move up and down respective stanchions and/or to maintain the auxiliary work surface 200 in a relatively horizontal configuration. Each set of guides 212 may consist of any combination of one or more rollers, slides, planer surfaces, or other similar feature capable of guiding and/or supporting the carriages relative to the stanchions.

It is also contemplated that this invention may be accomplished using gas cylinders, such as pneumatic, air, or other piston/cylinder combinations to raise and lower the auxiliary work surface when actuated.

In use, the adjustable desk apparatus 10 is selectively coupled to an existing desk to provide an auxiliary work surface 200 that is movable between a sitting configuration and a standing configuration. It should be appreciated that the auxiliary work surface 200 may be used to support standard office equipment and supplies such as a computer, books, files, a stapler, and the like. At the sitting configuration, a person has access to the office equipment and supplies while in a sitting position. At the standing configuration, a person has access to the office equipment and supplies while in a standing position. Upon transitioning between sitting and standing positions, the auxiliary work surface 200 may be moved between respective sitting and standing configurations so as to provide a work surface located at an appropriate height and to provide quick and convenient access to office equipment and supplies.

In one embodiment, a user pulls a position lock release handle 272 to pull a first pin 251 away from a first stanchion 110. The user then urges the auxiliary work surface 200 to a desired working height. A first adjustment assembly 300 assists the user in moving the auxiliary work surface 200 to the desired working height. More particularly, the first adjustment assembly 300 utilizes a counterweight 350 to urge the auxiliary work surface 200 upward, thus counteracting the gravitational force urging the auxiliary work surface 200 downward. Upon moving the auxiliary work surface 200 to the desired working height, the user releases the position lock release handle 272, thus allowing a spring 250 to bias the first pin 251 towards the first stanchion 110. The first pin 251 is received by a hole 150 defined by the first stanchion 110 so as to couple the auxiliary work surface 200 to the first stanchion 110. By coupling the auxiliary work surface 200 to the first stanchion 110, any imbalance in opposed urging forces is canceled out, thereby maintaining the auxiliary work surface 200 at the desired working height.

In other words, when the auxiliary work surface 200 is in the sitting configuration and a user pulls the position lock release handle 272 to pull the first pin 251 away from the first stanchion 110, the counterweight 350 may automatically move downward. As the counterweight 350 moves downward, the first adjustment assembly 300 moves the auxiliary work surface 200 upward. In the event that the counterweight 350 does not automatically move downward, a user may apply an upward urging force on the auxiliary work surface 200 to move the auxiliary work surface 200 upward. As the auxiliary work surface 200 moves upward, the first adjustment assembly 300 allows the counterweight 350 to move downward.

Similarly, when the auxiliary work surface 200 is in the standing configuration and a user pulls the position lock release handle 272 to pull the first pin 251 away from the first stanchion 110, the auxiliary work surface may automatically move downward. As the auxiliary work surface 200 moves downward, the first adjustment assembly 300 moves the counterweight 350 upward. In the event that the auxiliary work surface 200 does not automatically move downward, a user may apply a downward urging force on the auxiliary work surface 200 to move the auxiliary work surface 200 downward. As the auxiliary work surface 200 moves downward, the first adjustment assembly 300 moves the counterweight 350 upward.

It is understood that while certain forms of this invention have been illustrated and described, it is not limited thereto except insofar as such limitations are included in the following claims and allowable functional equivalents thereof.

The invention claimed is:

1. An adjustable desk apparatus configured to selectively sit on top of a primary work surface, comprising:

a base member coupled to the primary work surface;

a first adjustment assembly operatively coupled to said base member;

an auxiliary work surface operatively coupled to said first adjustment assembly, said first adjustment assembly being configured to selectively move said auxiliary work surface between a sitting configuration adjacent to the primary work surface and a standing configuration upwardly displaced from the primary work surface;

wherein:

said base member includes a generally vertical first stanchion; and said auxiliary work surface includes a first carriage configured to move up and down said first stanchion when said auxiliary work surface is moved between said sitting configuration and said standing configuration, respectively;

wherein said first adjustment assembly includes:

a pair of opposed counterweight sprockets coupled to said base member;

a first timing member coupled to a counterweight and operatively coupled to said auxiliary work surface so as to selectively urge said auxiliary work surface upward toward said standing configuration when said first timing member is coupled to said pair of sprockets.

2. The adjustable desk apparatus as in claim 1, wherein said base member includes a first stability member having at least one fastening member selectively coupled to a first edge of the primary work surface.

3. The adjustable desk apparatus as in claim 2, wherein said fastening member is adjustable so as to accommodate different sizes of primary work surfaces.

4. The adjustable desk apparatus as in claim 1, wherein said base member includes a first stability member having at least one fastening member selectively coupled to a fastening surface of the primary work surface.

5. The adjustable desk apparatus as in claim 1, wherein said auxiliary work surface is selectively coupled to said first stanchion when said auxiliary work surface is at said standing configuration.

6. The adjustable desk apparatus as in claim 5, wherein:

said auxiliary work surface includes a first pin selectively coupled to said first carriage; and said first stanchion defines at least one hole configured to receive said first pin so as to selectively hold said auxiliary work surface at said standing configuration.

7. The adjustable desk apparatus as in claim 6, wherein said first pin is spring biased towards said first stanchion.

8. The adjustable desk apparatus as in claim 7, wherein said auxiliary work surface includes a position lock release handle operatively coupled to said first pin, said position lock release handle being selectively movable between a relaxed configuration that enables said first pin to mate with said hole and a tensioned configuration pulling said first pin away from said at least one hole.

9. The adjustable desk apparatus as in claim 6, wherein:

said first stanchion defines a plurality of holes configured to selectively receive said first pin such that said auxiliary work surface is coupled to said first stanchion at a selected vertical position relative to the primary work surface;

said first pin is spring biased towards said first stanchion; and said auxiliary work surface includes a position lock release handle operatively coupled to said first pin.

10. The adjustable desk apparatus as in claim 1, wherein said first carriage includes a set of guides configured to engage opposed first and second surfaces of said first stanchion when said first carriage moves up and down relative to said first stanchion.

11. The adjustable desk apparatus as in claim 1, wherein said first adjustment assembly includes:

an idler pulley; and a counterweight cord;

wherein:

said idler pulley is coupled to said first stanchion of said base member;

a first end of said counterweight cord is coupled to a first end of said counterweight; and a second end of said counterweight cord is operatively coupled to said auxiliary work surface so as to urge said auxiliary work surface upward toward said standing configuration when said counterweight cord is coupled to said idler pulley.

12. The adjustable desk apparatus as in claim 1, wherein said first carriage is coupled to said first timing member with a clamp.

13. An adjustable desk apparatus configured to selectively sit on top of a primary work surface, comprising:

a base member coupled to the primary work surface;

a first adjustment assembly operatively coupled to said base member;

an auxiliary work surface operatively coupled to said first adjustment assembly, said first adjustment assembly being configured to selectively move said auxiliary work surface between a sitting configuration adjacent to the primary work surface and a standing configuration upwardly displaced from the primary work surface;

wherein:

said base member includes a generally vertical first stanchion; and said auxiliary work surface includes a first carriage configured to move up and down said first stanchion when said auxiliary work surface is moved between said sitting configuration and said standing configuration, respectively;

a counterweight;

a pair of opposed counterweight sprockets coupled to said base member;

a first timing member coupled to said counterweight; and a second timing member operatively coupled to said auxiliary work surface so as to urge said auxiliary work surface upward toward said standing configuration when said first and second timing members are coupled to said counterweight sprockets.

14. The adjustable desk apparatus as in claim 13, wherein each of said counterweight sprockets defines a first diameter for said first timing member and a second diameter for said second timing member.

15. The adjustable desk apparatus as in claim 13, wherein said first carriage is coupled to said second timing member with a clamp.

16. The adjustable desk apparatus as in claim 13, wherein said base member includes a substantially vertical second stanchion; and said auxiliary work surface includes a second carriage configured to move up and down said second stanchion.

17. The adjustable desk apparatus as in claim 16, further comprising a second adjustment assembly operatively coupled to said base member and said auxiliary work surface, wherein said second adjustment assembly includes:

a counterweight;

a pair of opposed counterweight sprockets coupled to said base member;

a first timing member coupled to said counterweight; and a second timing member operatively coupled to said auxiliary work surface so as to selectively urge said auxiliary work surface upward toward said standing configuration when said first and second timing members are coupled to said pair of sprockets.

18. The adjustable desk apparatus as in claim 17, wherein:

said base member includes at least one longitudinal member coupled to and extending between respective first and second stanchions;

the auxiliary work surface includes at least one longitudinal member coupled to and extending between respective first and second carriages; and at least one timing bar extends between respective timing sprockets of respective first and second adjustment assemblies.

* * * * *